US007121050B2

(12) United States Patent
Richardson

(10) Patent No.: US 7,121,050 B2
(45) Date of Patent: Oct. 17, 2006

(54) FASCIAS

(75) Inventor: Christopher Richardson, Lancashire (GB)

(73) Assignee: Ultraframe (UK) Limited, Lancashire (GB)

( * ) Notice: Subject to any disclaimer, the term of this patent is extended or adjusted under 35 U.S.C. 154(b) by 0 days.

(21) Appl. No.: 11/197,127

(22) Filed: Aug. 4, 2005

(65) Prior Publication Data

US 2006/0000156 A1 Jan. 5, 2006

Related U.S. Application Data

(63) Continuation of application No. 09/793,305, filed on Feb. 26, 2001, now abandoned.

(30) Foreign Application Priority Data

Feb. 26, 2000 (GB) ..... 0004523.7

(51) Int. Cl.
*E04D 13/15* (2006.01)
*E04F 19/02* (2006.01)

(52) U.S. Cl. ..... 52/287.1; 52/288.1; 52/82; 52/94; 52/716.1

(58) Field of Classification Search ..... 52/82, 52/94, 312, 716.1, 287.1, 288.1; D25/136
See application file for complete search history.

(56) References Cited

U.S. PATENT DOCUMENTS 3,074,521 A * 1/1963 Woods ..... 52/288.1
3,378,973 A * 4/1968 Tudor-Pole ..... 52/466
4,263,756 A * 4/1981 Middleby ..... 52/11
5,199,237 A * 4/1993 Juntunen ..... 52/287.1
5,398,469 A * 3/1995 Logan ..... 52/288.1
5,592,797 A * 1/1997 Logan et al. ..... 52/288.1
5,802,790 A * 9/1998 Lamont et al. ..... 52/288.1
5,809,718 A * 9/1998 Wicks ..... 52/287.1
6,317,945 B1 * 11/2001 Laphan et al. ..... 27/10
6,385,927 B1 * 5/2002 Schiedegger et al. ..... 52/211
2001/0017014 A1 * 8/2001 Richardson ..... 52/204.53
2001/0045076 A1 * 11/2001 Boomer ..... 52/716.1

FOREIGN PATENT DOCUMENTS

EP 0 328 394 * 9/1989
GB 1 422 550 * 10/1970
GB 1 421 484 * 1/1976
GB 1 422 550 * 1/1976
GB 2 191 518 A * 12/1987
GB 2 271 588 A * 4/1994
GB 2 312 221 A * 10/1997
GB 2 360 048 A * 9/2001
GB 2 400 427 A * 10/2004
WO 01/63070 A1 * 9/2001

* cited by examiner

*Primary Examiner*—Robert Canfield
(74) *Attorney, Agent, or Firm*—Wood, Phillips, Katz, Clark & Mortimer

(57) ABSTRACT

A connecting piece is provided to be fitted where fascia boards are intended to meet, especially at corners of conservatory roofs. The connecting piece has a front face and a rear face, edges of the rear face being shaped to correspond to the outer profile of the fascia boards and means for retaining the connecting piece between adjacent ends of the fascia boards.

3 Claims, 4 Drawing Sheets

FASCIAS

This application is a continuation of application Ser. No. 09/793,305, filed Feb. 26, 2001 and now abandoned.

TECHNICAL FIELD OF THE INVENTION

This invention concerns fascias and in particular fascias for eaves beams of conservatory roof systems.

BACKGROUND OF THE INVENTION

Conservatory roof systems constructed from aluminium frameworks generally comprise glazing bars supporting glazing panels, the glazing bars being mounted at their lower ends onto eaves beams. The eaves beams are supported on walls or windows forming the sides of the conservatory. For decorative and thermal purposes, aluminium framework members are usually concealed behind u-PVC claddings. Eaves beams are usually concealed behind fascia boards.

A typical eaves beam can have one or more formations on its intended inner face, which engage corresponding formations of fascia boards. Typically, the fascia boards have barb like ribs that can be pushed into channels or slots on the inner face of the eaves beams or vice versa.

The fascia boards have to be cut to length, but if that is not done sufficiently accurately, there can be unsightly gaps at corners of the conservatory roof were the fascia boards meet. There exists therefore a need for some means of improving the appearance where fascia boards for conservatory roof eaves beams meet, especially at corners.

SUMMARY OF THE INVENTION

An object of this invention is to provide a connecting piece for fascia boards.

According to the present invention, there is provided a connecting piece to be fitted where fascia boards are intended to meet, especially at corners of conservatory roofs, the connecting piece having a front face and a rear face, edges of the rear face being shaped to correspond to the outer profile of the fascia boards and means for retaining the connecting piece between adjacent ends of the fascia boards.

The invention further provides a cladding system, suitable for conservatory roof systems, especially at the eaves thereof, comprising a pair of fascia boards and a connecting piece having a front face and a rear face, edges of the rear face being shaped to correspond to the outer profile of the fascia boards and means for retaining the connecting piece between adjacent ends of the fascia boards.

The means for retaining the connecting piece preferably comprises an extension from the rear face of the connecting piece having at its remote end a pair of wings, providing slots between each wing and the rear face of the connecting piece for receiving a fascia board end.

One or more tabs or the like may be provided on top edges of the connecting pieces to sit on top edges of the fascia boards to aid positioning and retention of the connecting pieces.

The connecting piece preferably has an aperture for receiving a selectable decorative insert, so that the fascia can be decorated according to a customer's requirements without having to use different connecting pieces but simply by changing the insert.

Preferably the retaining means is connected to the edge of the aperture especially at substantially diametrically opposed points. By having the connecting piece retaining extension from edges of the aperture, such as from two diametrically opposed points, the corner piece can be molded in one by facilitating separation of mold parts.

The decorative inserts may be fixed to the corner pieces by any suitable means. It may, however, be convenient for the inserts to have resilient tabs on their rear face that locate behind edges of the aperture or more preferably in slots provided in the connections between the retaining extension and its connections to the edges of the aperture.

Connecting pieces may be provided for different corner angles, typically 150°, 135° and 90° internal and external corners, and for straight connections. The front face of the connecting piece can be designed so as to match the fascia board profile with which they are to be used.

Whilst the invention is particularly suitable for eaves beam cladding inside conservatory roof systems, connecting pieces of the invention may be used in improving the appearance where fascia boards or cladding panels meet in other situations.

BRIEF DESCRIPTION OF THE DRAWINGS

This invention will now further be described, by way of example, with reference to the accompanying drawings, in which.

DETAILED DESCRIPTION OF THE ILLUSTRATED EMBODIMENT

Figure 1:
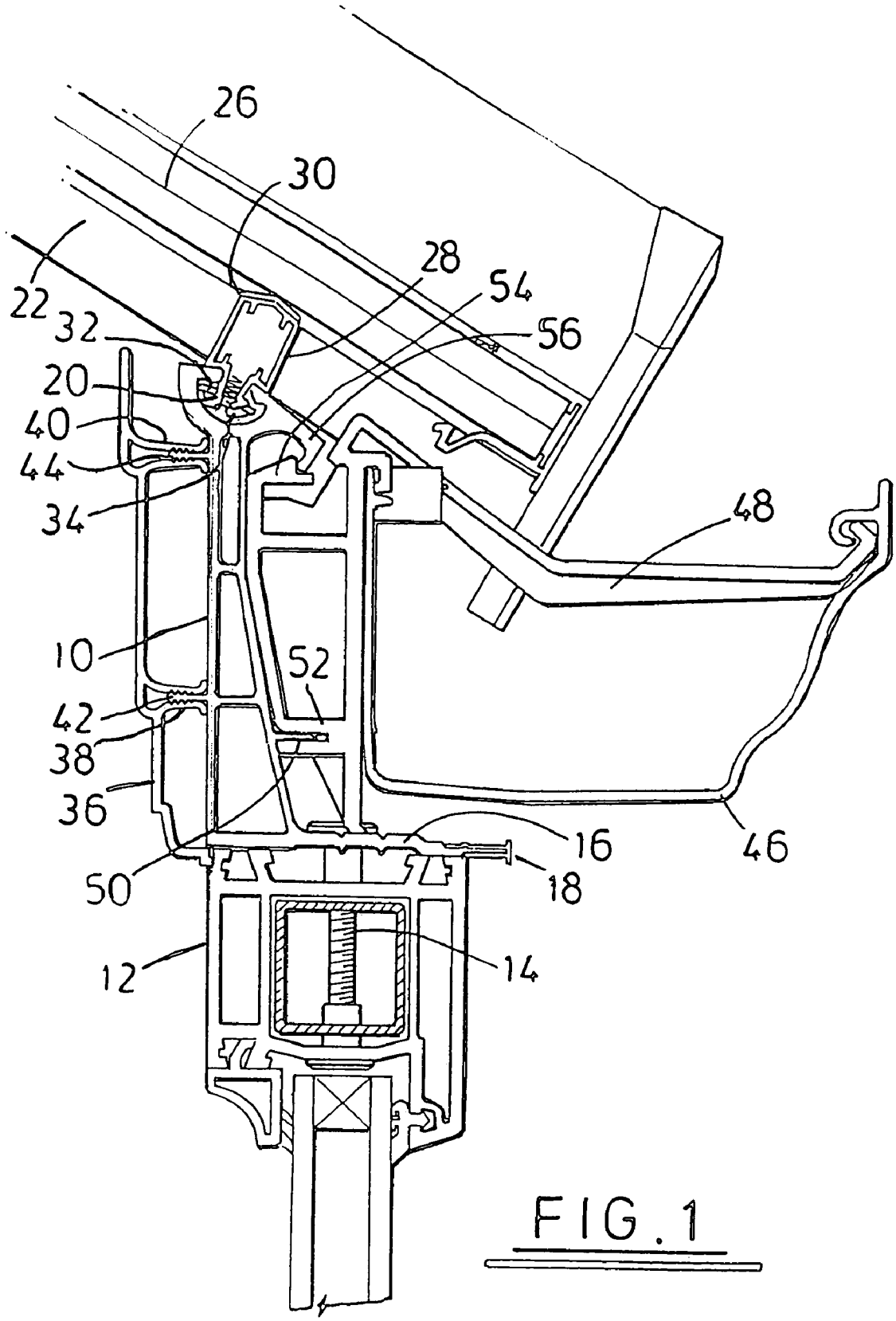
FIG. 1 is a section through a typical conservatory roof eaves beam arrangement.
Figure 2:
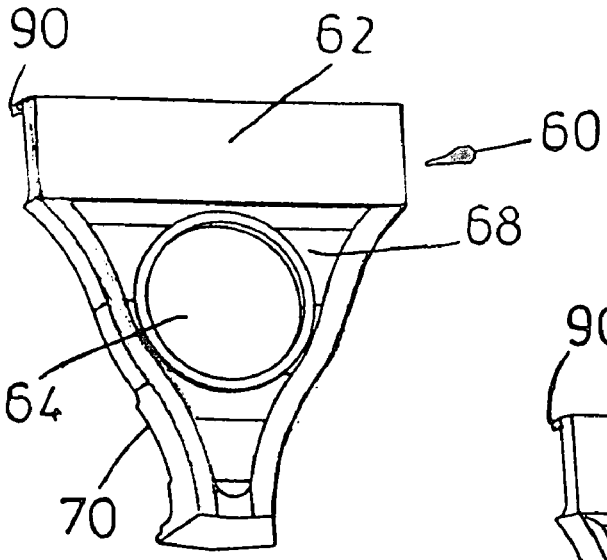
FIG. 2 shows a connecting piece according to the invention without decorative insert.
Figure 3:
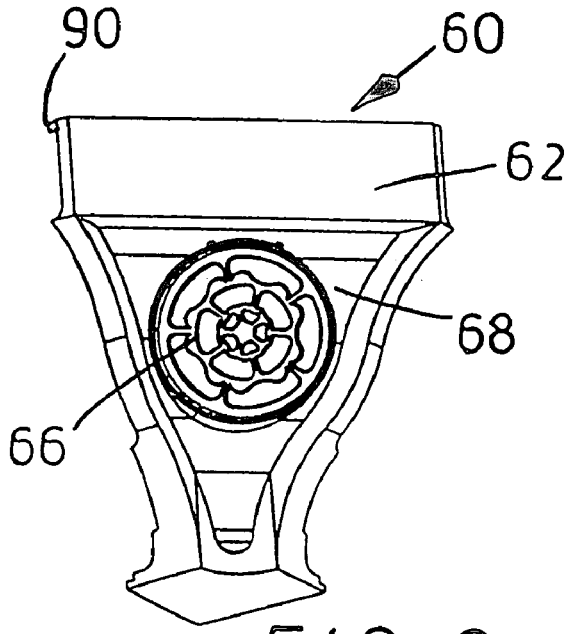
FIG. 3 shows the connecting piece of FIG. 2 with a decorative insert.
Figure 6:
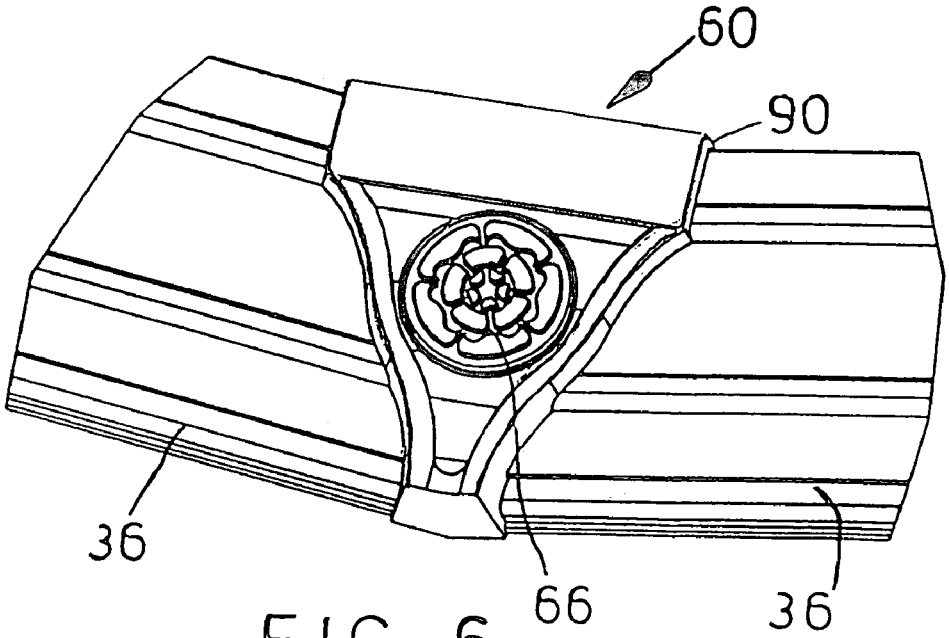
FIG. 6 is a front view of a fascia arrangement with a connecting piece of the invention.
Figure 5:
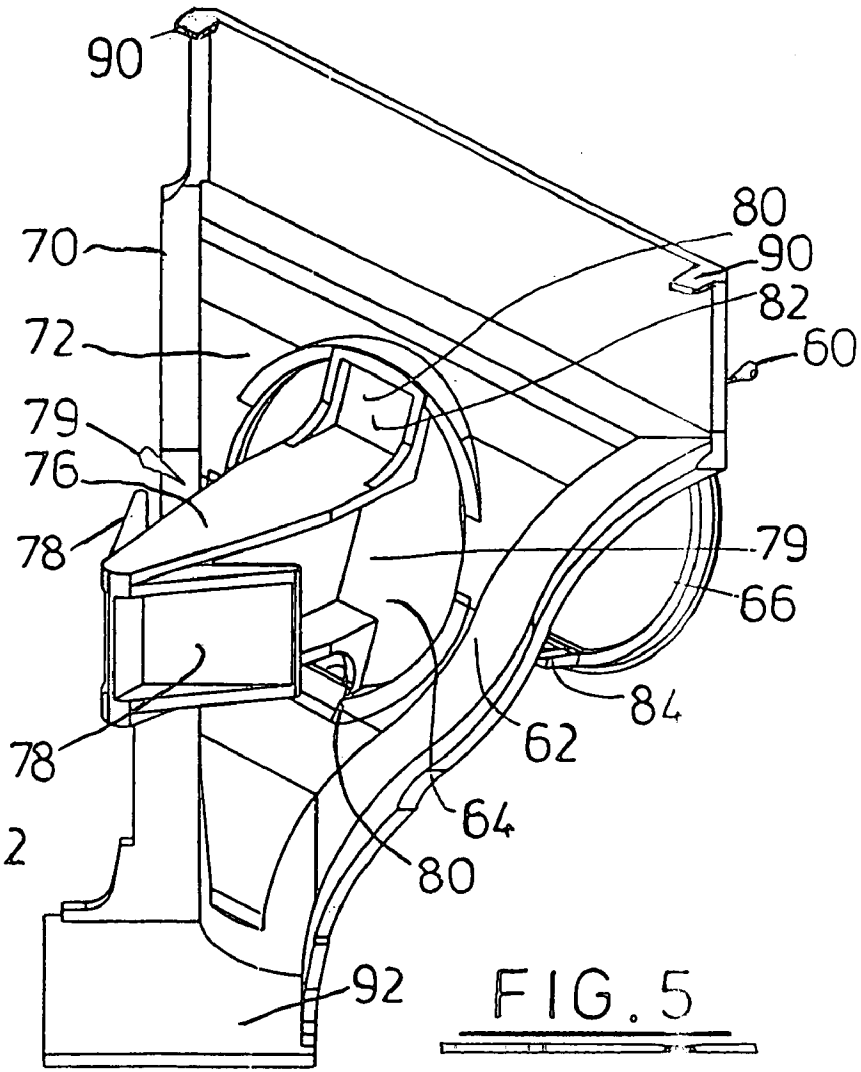
FIG. 5 is a rear view of a connecting piece according to the invention.
Figure 4:
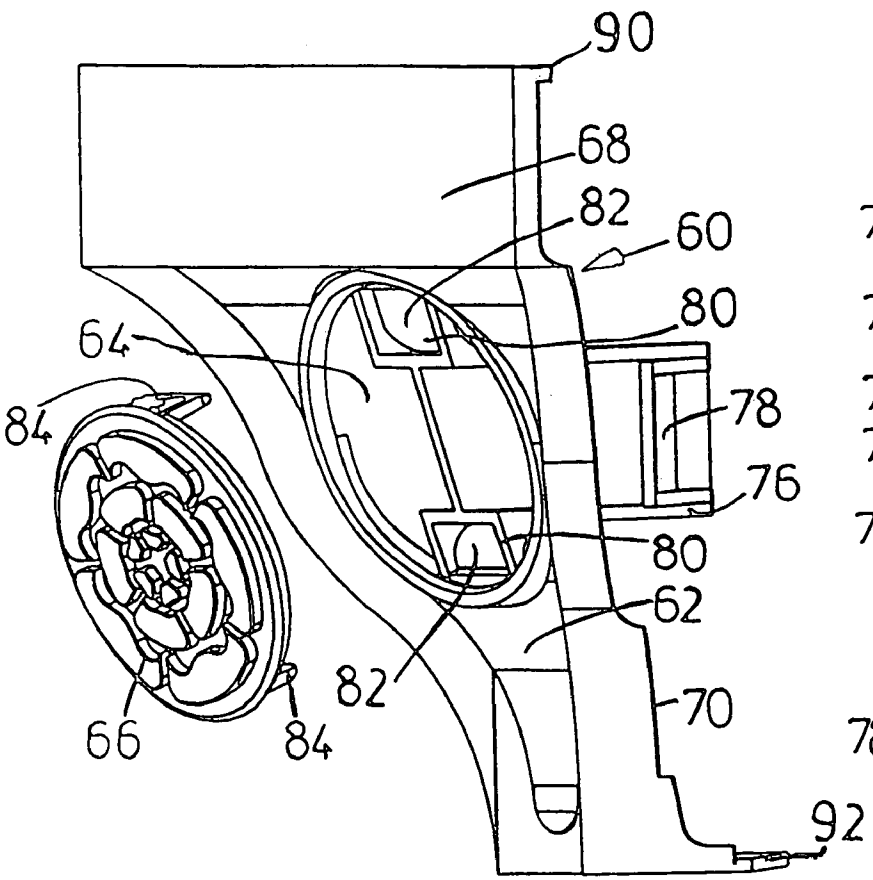
FIG. 4 is a side view of a connecting piece according to the invention.
Figure 7:
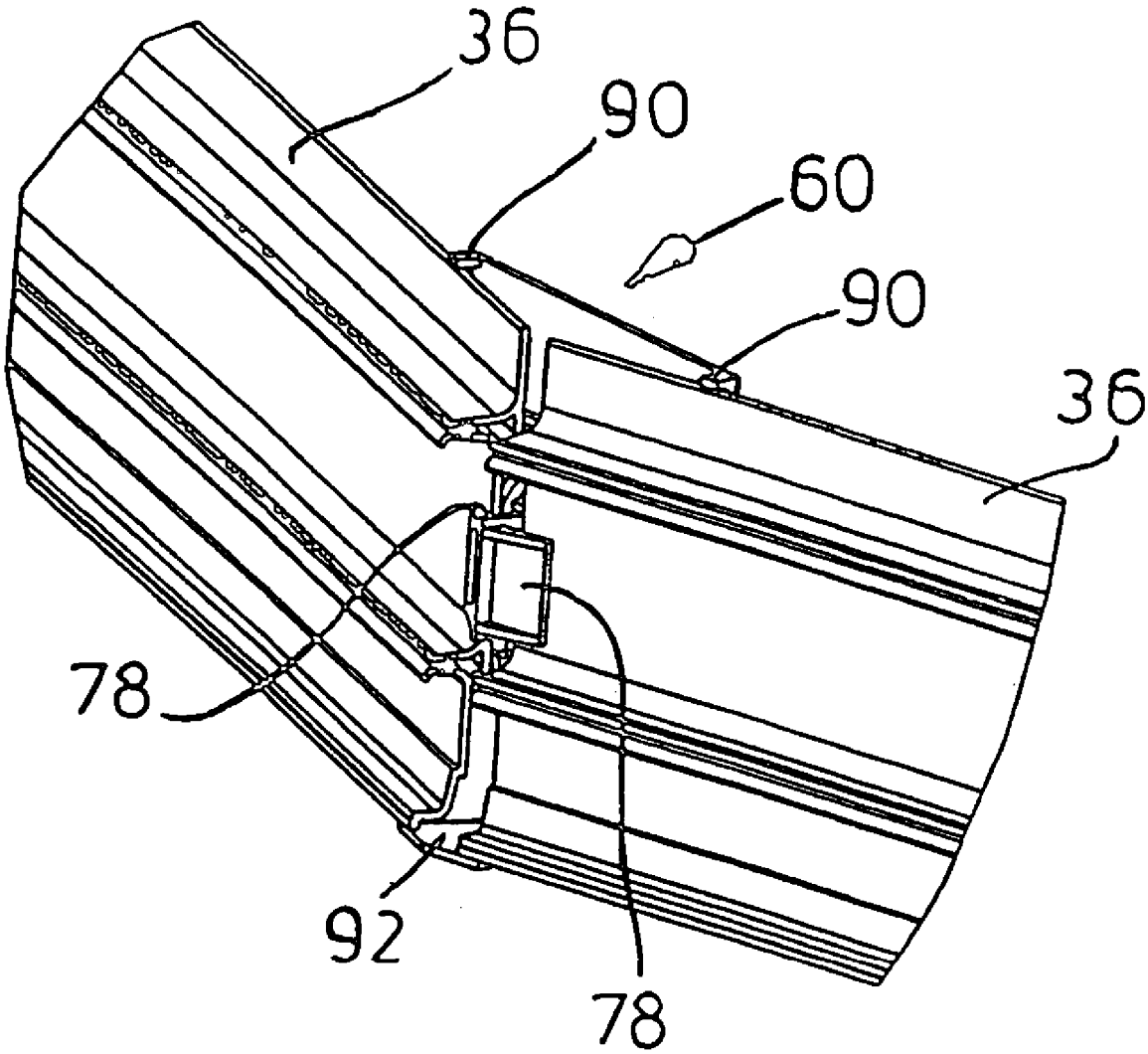
FIG. 7 is a rear view of the fascia arrangement of FIG. 6.

Referring to FIG. 1 of the accompanying drawings, part of the eaves structure of a conservatory roof is shown, in which eaves beam 10 is mounted on top of window frame 12 forming part of the side wall of the conservatory. Bolts 14 through the frame 12 and the base 16 of the eaves beam secure the eaves beam to the frame. The free end of the base 16 has a PVC cover strip 18 pushed canto it.

Secured to pivotable bolt 20 in the head of the eaves beam are glazing bars 22 which support a glazing panel 26. Between the bolts 20 extruded plastics trim 28 is provided. The trim 28 has a top surface which bears a foam strip 30 that has an adhesive coating to seal onto the under side of the glazing panels. The trim 28 has a bottom formation 32 whereby it clips into channel 34 of the eaves beam. Internal cladding or fascia board 36 has slots 38, 40 which enable the cladding to be push fitted onto the barbed ribs 42, 44 of the eaves beam 10. A gutter 46 is mounted in brackets 48 which are connected to the eaves beam by means of barb 50 which fits a slot 52 of the bracket and the top return 54 of the bracket locates behind the free end of flange 56 of the eaves beam.

The internal cladding or fascia board 36 has an ornate profile but claddings of other profiles can be used instead. FIG. 1 of the drawings shows that there is a gap between the fascia board and the eaves beam.

Where fascia boards meet at corners of the conservatory, it is intended that they be cut to a length to leave a gap at the corners to accommodate connecting pieces 60 as shown in FIGS. 2 to 7 of the accompanying drawings. The connecting pieces 60 are molded of plastics, such as polypropylene or u-PVC and comprise a main body 62 with a circular aperture 64 which receives a decorative insert 66. The main body 62 has a front face 68 that is provided with decorative profile to match the fascia board profile. Edges 70 of rear face 72 of the connecting piece are shaped also to match the profile of the fascia board, in order to fit snugly there-against.

Extending from the rear face 72 of the connecting piece and connected (80) at diametrically opposed positions to the edge of the aperture 64 is a retaining extension 76. The extension 76 tapers towards its free end at which are a pair of wings 78, one on each side. The wings 78 with the rear face of the connecting piece forms slots 79 to receive ends of the fascia board 36. The top edge of the connecting piece has a pair of tabs 90 that sit on the top edges of the fascia board to assist positioning and retention of the connecting piece. The connecting piece has its bottom formed as a platform or ledge 92, on which bottom edges of the fascia boards can sit.

The connections 80 between the retaining extension 76 and the edges of the aperture 64 include slots 82 that are to receive resilient tabs 84 on the rear face of the decorative pieces 66, whereby the decorative pieces can be snap fitted over the aperture. A variety of styles of decorative insert can be provided so that a customer can select the decorative inserts accordingly to his or her requirements.

The connecting pieces are fitted simply by pushing the fascia boards into the slots 79 on either side of the connecting piece and offering the fascia boards up to the eaves beam. Usually a connecting piece will be pushed onto a first length of fascia board and the combination offered up to the eaves beam. Then the adjoining fascia board with a connecting piece on its other end can be slid into the connecting piece already in position as well as being offered to the eaves beam and so the appropriate decorative inserts can be added at any time during the fitting process.

By having the retaining extension 76 within the confines of the overall size of the aperture it is possible to mold the connecting piece, without the insert, in one piece because there is a gap on either side of the retaining extension allowing the cover piece to be molded between two mold parts only. Thus, the aperture which accommodates the decorative insert-improves the manufacturing process and assists the installation of the connecting piece.

Although the invention has been described specifically in relation to eaves beam cladding for a conservatory roof, the same type of arrangement can be used in other cladding situations, where it is desired to improve the appearance at corners where cladding pieces meet.

The invention claimed is:

1. For eaves beams of a conservatory roof, a cladding system comprising a pair of fascia boards, which have an outer, decorative profile, and a connecting piece connecting the fascia boards, the connecting piece having a front face and a rear face, the front face having a decorative profile matching the outer, decorative profile of the fascia boards, the rear face having edges matching the outer, decorative profile of the fascia boards, the connecting piece having a retaining extension, which fits between adjacent ends of the fascia boards but which does not extend through either of the fascia boards, the connecting piece having means for retaining the retaining extension of the connecting piece between the adjacent ends of the fascia boards, wherein the connecting piece has an aperture receiving a decorative insert.

2. The cladding system of claim 1, wherein the aperture receiving the decorative insert extends completely through the connecting piece, from the front face to the rear face.

3. The cladding system of claim 2, wherein the decorative insert has decorative tabs that are located behind edges of the aperture, at the rear face of the connecting piece.

* * * * *